US010360895B2

(12) United States Patent
Cheung et al.

(10) Patent No.: US 10,360,895 B2
(45) Date of Patent: Jul. 23, 2019

(54) DYNAMIC SOUND ADJUSTMENT BASED ON NOISE FLOOR ESTIMATE

(71) Applicant: Bose Corporation, Framingham, MA (US)

(72) Inventors: Shiufun Cheung, Lexington, MA (US); Zukui Song, Wellesley, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/850,847

(22) Filed: Dec. 21, 2017

(65) Prior Publication Data

US 2019/0198005 A1 Jun. 27, 2019

(51) Int. Cl.
*G10K 11/178* (2006.01)

(52) U.S. Cl.
CPC .. *G10K 11/17827* (2018.01); *G10K 11/17813* (2018.01); *G10K 11/17881* (2018.01); *G10K 11/17883* (2018.01)

(58) Field of Classification Search
None
See application file for complete search history.

(56) References Cited

U.S. PATENT DOCUMENTS 5,615,270 A * 3/1997 Miller ..... H03G 3/32 381/108
9,159,336 B1 10/2015 Yang
9,615,185 B2 4/2017 Song et al.
9,906,859 B1 2/2018 Song et al.
9,917,565 B2 3/2018 Song et al.
2005/0114128 A1* 5/2005 Hetherington ..... G10L 21/0208 704/233
2010/0017205 A1 1/2010 Visser et al.
2010/0094625 A1* 4/2010 Mohammad ..... G10L 25/48 704/233
2012/0224718 A1* 9/2012 Sugiyama ..... G10L 21/0208 381/94.1

(Continued)

OTHER PUBLICATIONS

Martin; "Noise Power Spectral Density Estimation Based on Optimal Smoothing and Minimum Statics"; IEEE Transactions on Speech and Audio Processing; vol. 9, No. 5, Jul. 2001; 9 pages.

(Continued)

*Primary Examiner* — James K Mooney
(74) *Attorney, Agent, or Firm* — Fish & Richardson P.C.

(57) ABSTRACT

The technology described in this document can be embodied in a method that includes receiving a plurality of representations of the signal corresponding to samples of the signal within a frame of predetermined time duration, and estimating a power spectral density (PSD) for each of a plurality of frequency bins. The PSD for a particular frequency bin is estimated based on a smoothing parameter calculated from a noise estimate for the particular frequency bin as obtained from samples corresponding to a preceding frame. The method also includes generating, based on the PSD for each of the plurality of frequency bins, an estimate of the steady-state noise floor, and computing a measure of spectral flatness associated with the samples within the frame. The method also includes determining that the measure of spectral flatness satisfies a threshold condition, and in response, computing an updated estimate of the steady-state noise floor.

20 Claims, 4 Drawing Sheets

(56) References Cited

U.S. PATENT DOCUMENTS

| | | | | |
|---|---|---|---|---|
| 2014/0337021 | A1 | 11/2014 | Kim et al. | |
| 2015/0281864 | A1* | 10/2015 | Song | H04R 29/00 381/56 |
| 2017/0236528 | A1 | 8/2017 | Lepauloux et al. | |

OTHER PUBLICATIONS

Shynk, John J. Frequency Domain and Multi-Rate Adaptive Filtering. IEEE Signal Processing Magazine. Jan. 1992; 24 pages.
International Search Report and Written Opinion; PCT/US2018/065999; dated Mar. 1, 2019; 15 pages.

* cited by examiner

DYNAMIC SOUND ADJUSTMENT BASED ON NOISE FLOOR ESTIMATE

TECHNICAL FIELD

This disclosure generally relates to dynamic sound adjustment, e.g., to overcome the effect of noise on sound reproduction in a moving vehicle.

BACKGROUND

The perceived quality of music or speech in a moving vehicle may be degraded by variable acoustic noise present in the vehicle. This noise may result from, and be dependent upon, vehicle speed, road condition, weather, and condition of the vehicle. The presence of noise may hide soft sounds of interest and lessen the fidelity of music or the intelligibility of speech. A driver and/or passenger(s) of the vehicle may partially compensate for the increased noise by increasing the volume of the audio system. However, when the vehicle speed decreases or the noise goes away, the increased volume of the audio system may become too high, requiring the driver or the passenger(s) to decrease the volume.

SUMMARY

In one aspect, this document features a method for estimating a steady-state noise floor in a signal. The method includes receiving a plurality of representations of the signal corresponding to samples of the signal within a frame of predetermined time duration, and estimating, by one or more processing devices, a power spectral density (PSD) for each of a plurality of frequency bins. The PSD for a particular frequency bin is estimated based on a smoothing parameter calculated from a noise estimate for the particular frequency bin as obtained from samples corresponding to a preceding frame. The method also includes generating, based on the PSD for each of the plurality of frequency bins, an estimate of the steady-state noise floor, and computing a measure of spectral flatness associated with the samples within the frame. The measure of flatness is calculated based on PSDs calculated for at least a portion of the plurality of frequency bins. The method also includes determining that the measure of spectral flatness satisfies a threshold condition, and in response, computing an updated estimate of the steady-state noise floor.

In another aspect, this document features a system for estimating a steady-state noise floor in a signal. The system includes a steady-state noise estimator having one or more processing devices, the steady-state noise estimator configured to receive a plurality of representations of the signal corresponding to samples of the signal within a frame of predetermined time duration, and estimate a power spectral density (PSD) for each of a plurality of frequency bins. The PSD for a particular frequency bin is estimated based on a smoothing parameter calculated from a noise estimate for the particular frequency bin as obtained from samples corresponding to a preceding frame. The steady-state noise estimator is also configured to generate, based on the PSD for each of the plurality of frequency bins, an estimate of the steady-state noise floor. The system also includes a spectral flatness estimator configured to compute a measure of spectral flatness associated with the samples within the frame. The measure of flatness is calculated based on PSDs calculated for at least a portion of the plurality of frequency bins, and fed back to the steady-state noise estimator. The steady state noise estimator is further configured to determine, based on feedback from the spectral flatness estimator, that the measure of spectral flatness satisfies a threshold condition, and in response, compute an updated estimate of the steady-state noise floor.

In another aspect, this document features one or more machine-readable storage devices having encoded thereon computer readable instructions for causing one or more processing devices to perform various operations. The operations include receiving a plurality of representations of the signal corresponding to samples of the signal within a frame of predetermined time duration, and estimating a power spectral density (PSD) for each of a plurality of frequency bins. The PSD for a particular frequency bin is estimated based on a smoothing parameter calculated from a noise estimate for the particular frequency bin as obtained from samples corresponding to a preceding frame. The operations also include generating, based on the PSD for each of the plurality of frequency bins, an estimate of the steady-state noise floor, and computing a measure of spectral flatness associated with the samples within the frame. The measure of flatness is calculated based on PSDs calculated for at least a portion of the plurality of frequency bins. The operations further include determining that the measure of spectral flatness satisfies a threshold condition, and in response, computing an updated estimate of the steady-state noise floor.

Implementations may include one or more of the following features.

The updated estimate of the steady-state noise floor can be computed as a function of the noise estimate for the corresponding frequency bin as obtained from the samples corresponding to the preceding frame. The output of a vehicular audio system can be adjusted based on the estimate of the steady-state noise floor. The steady-state noise floor can represent a steady-state noise within a vehicle-cabin associated with the vehicular audio system. Adjusting the output of the vehicular audio system can include receiving an input signal indicative of noise within the vehicle-cabin, computing a signal to noise ratio (SNR) indicative of a relative power of the output of the vehicular audio system compared to the power of the input signal indicative of the noise, and generating a control signal for adjusting the vehicular audio system as a function of the SNR. The control signal can boost the output of the vehicular audio system in accordance with a difference between the SNR and a threshold, the output being constrained to an upper limit. Adjusting the output of the vehicular audio system can also include receiving an input signal indicative of noise within the vehicle-cabin, computing a signal to noise ratio (SNR) indicative of a relative power of the output of the vehicular audio system compared to the power of the input signal, and maintaining a gain level of the vehicular audio system upon determining that the SNR satisfies a threshold condition. The smoothing parameter for the particular frequency bin can be calculated based also on an estimate of PSD for the same frequency bin in a preceding frame. Estimating the steady-state noise floor can include determining a spectral minimum over the frame of predetermined time duration. Determining the spectral minimum over the predetermined time duration can include dividing the corresponding PSDs into a plurality of sub-windows, and, determining a running minimum of PSDs in the sub-windows. The plurality of representations of the signal can include time-domain representations. The plurality of representations of the signal can include frequency-domain representations.

In some implementations, the technology described herein may provide one or more of the following advantages.

By determining a noise floor associated with steady state noise, and by controlling a noise compensation system based on a signal to noise ratio (SNR) calculated using the noise floor, unnecessary triggering of the compensation system due to transient noise spikes can be mitigated. Dynamic updates to the noise floor estimates may help in accounting for changes to steady state noise. This may be used in conjunction with a flatness test to accept or reject an estimate update to account for transient changes that likely do not contribute to the steady-state noise. By determining the noise floor in a limited frequency band, the effects of "irrelevant" noise such as noise due to speech and/or impulses may be alleviated. In some implementations, using a divide-and-conquer approach in finding the noise floor may significantly reduce memory usage in implementing the technology.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

The technology described in this document is directed at dynamically estimating a noise floor associated with steady-state noise perceived within a noisy environment such as a vehicle cabin. The estimate of the noise floor can then be used to mitigate the effect of noise on a perceived quality of a reproduction system delivering audio output in the vehicle cabin. In some implementations, one or more controllers can be configured/programmed to analyze, substantially continuously, the noise detected by one or more detectors located within the vehicle cabin, and the sound produced by the audio system, and to adjust the audio reproduction based on the analysis. For example, if the noise detected within the vehicle cabin increases, the gain associated with the output of the audio system may be increased to maintain a substantially constant signal to noise ratio (SNR) as perceived by the occupants. Conversely, if the noise level goes down (e.g., due to vehicle slowing down), the gain associated with the output of the audio system may be decreased to maintain the SNR at a target level.

Because the gain adjustment to maintain a target SNR reacts to changing noise levels, in some cases it may be desirable to base the computation of the SNR on steady-state noise that does not include noise spikes and/or noise irrelevant to the adjustments. For example, speech sounds from the occupants of the vehicle and/or any noise spike due to the vehicle going over a pothole may be considered irrelevant for adjusting the gain of the audio system, and therefore be excluded from the estimation of steady state noise. On the other hand, noise components such as engine noise, harmonic noise, and/or road noise perceived within the vehicle cabin may be considered relevant to estimating the steady-state noise that the gain adjustment system reacts to. In general, the term steady-state noise, as used in this document, refers to noise that is desired to be mitigated within the noise-controlled environment. For example, the steady-state noise can include engine noise, road noise etc., but excludes noise spikes and/or speech and/or other sounds made by the occupant(s) of the vehicle.

Figure 1:
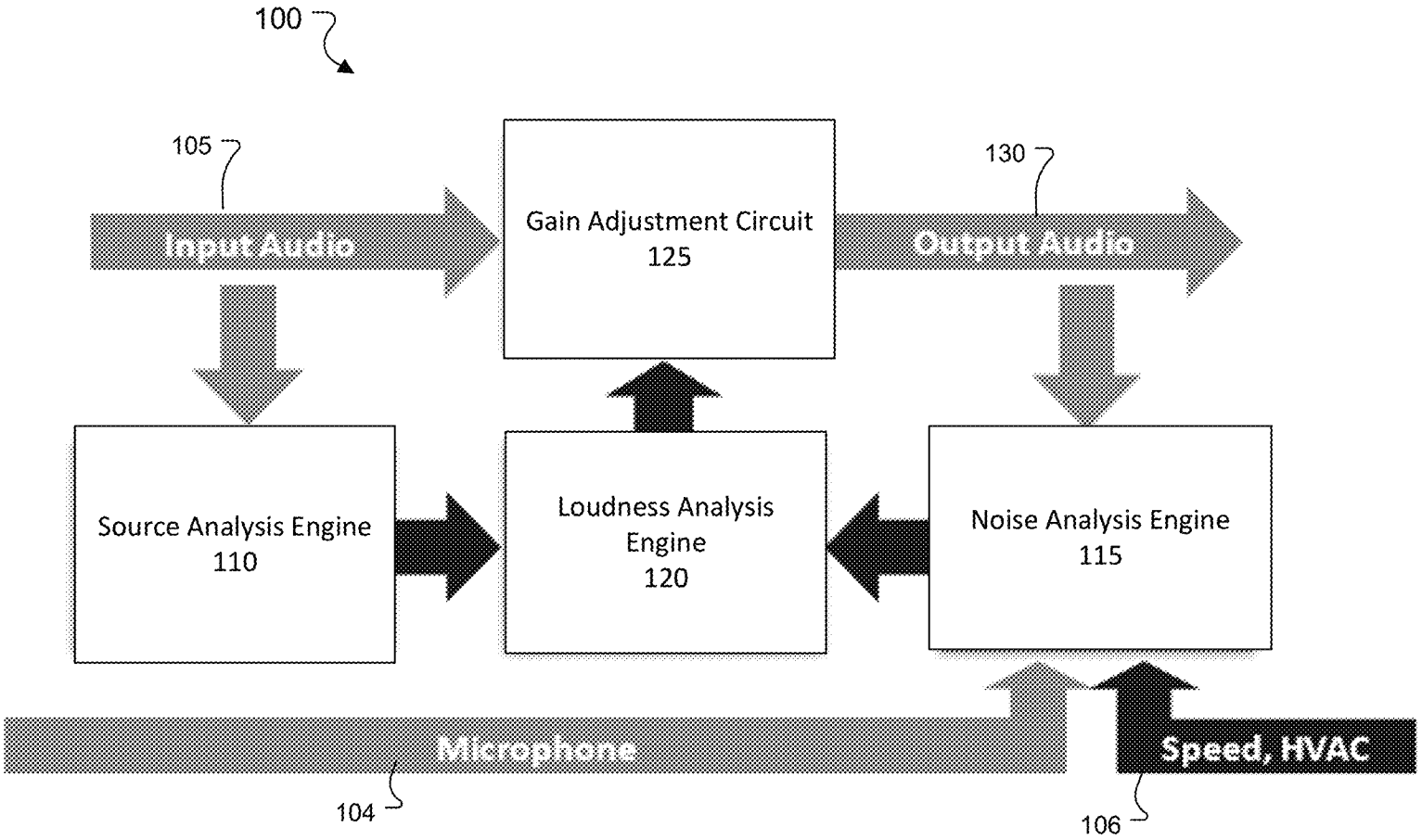
FIG. 1 is a block diagram of an example system for adjusting output audio in a vehicle cabin.

FIG. 1 is a block diagram of an example system 100 for adjusting output audio in a vehicle cabin. The input audio signal 105 is first analyzed to determine a current record level of the input audio signal 105. This can be done, for example, by a source analysis engine 110. In parallel, a noise analysis engine 115 can be configured to analyze the level and profile of the noise present in the vehicle cabin. In some implementations, the noise analysis engine can be configured to make use of multiple inputs such as a microphone signal 104 and one or more auxiliary noise input 106 including, for example, inputs indicative of the vehicle speed, fan speed settings of the heating, ventilating, and air-conditioning system (HVAC) etc. In some implementations, a loudness analysis engine 120 may be deployed to analyze the outputs of the source analysis engine 110 and the noise analysis engine 115 to compute any gain adjustments needed to maintain a perceived quality of the audio output. In some implementations, the target SNR can be indicative of the quality/level of the input audio 105 as perceived within the vehicle cabin in the presence of steady-state noise. The loudness analysis engine can be configured to generate a control signal that controls the gain adjustment circuit 125, which in turn adjusts the gain of the input audio signal 105, possibly separately in different spectral bands to perform tonal adjustments, to generate the output audio signal 130.

The level of the input audio signal and the noise level may be measured as decibel sound pressure level (dBSPL). For example, the source analysis engine 110 can include a level detector that outputs a scalar dBSPL estimate usable by the loudness analysis engine 120. The noise analysis engine 115 can also be configured to estimate the noise as a dBSPL value.

Figure 2A:
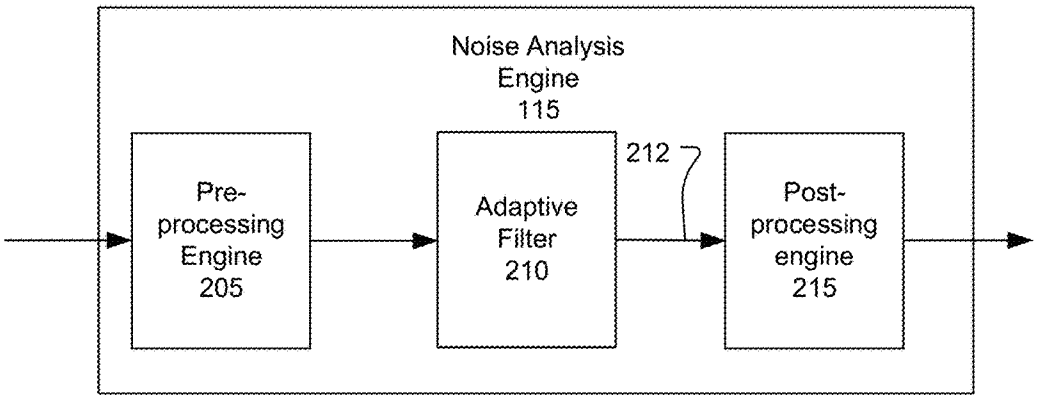
FIG. 2A is a block diagram of an example noise analysis engine that may be used in the system depicted in FIG. 1.

FIG. 2A is a block diagram of an example noise analysis engine 115. The noise analysis engine 115 can include a pre-processing engine 205, one or more adaptive filters 210, and a post-processing engine 215. In some implementations, the noise analysis engine 115 can be configured to operate on the entire spectrum of noise. However, in some cases, a full-band noise estimator can be computationally intensive and/or memory intensive, for example, due to a long impulse response associated with a vehicle cabin transfer function. In some implementations, noise estimation may therefore be performed using narrow-band noise samples, and approximating the noise spectral shape by comparing the multiple samples. Therefore, while FIG. 2A shows a single signal flow pathway, in some implementations, the noise analysis engine 115 can include multiple pathways each for a respective frequency range.

The pre-processing engine 205 can be configured in accordance with the range of frequencies. For example, in the low frequency range, pre-processing engine 205 can include one or more low pass filters (e.g., a low-pass filter with a cutoff frequency of approximately 100 Hz) to filter the microphone signal 104 and/or any reference signal used in the subsequent adaptive filters 210. In some implementations, the signal sampling rate may be decimated to increase computational efficiency. For example, with a low pass filtered signal limited to 100 Hz, the sample rate can be decimated by a factor of 64.

For higher frequency ranges, the pre-processing engine 205 can include, for example, a band-pass filter to limit the microphone signal 104 and/or any reference signals to a corresponding frequency range. In some implementations, the preprocessing engine 205 can include a decimator to reduce the sampling rate, for example, to reduce computational burden associated with the subsequent processing. In one example, the operational frequency range of the high-frequency noise estimator was kept at 4-6 kHz. A 12th-order Butterworth band-pass filter with corner frequencies of 4.41 kHz and 5.4 kHz was used to sample the band of interest. The bandlimited signal was then shifted to the baseband as a low-pass signal for further processing. For this downshift, the band-passed signal was multiplied by a 4.41 kHz (1/10 of the sampling frequency) sinusoidal signal, resulting in a base-band signal with a bandwidth of 1 kHz. Anti-aliasing was then applied, followed by decimation by a factor of 16. The anti-aliasing filter used was a 4th-order elliptic filter with a cut-off frequency of 1200 Hz and passband ripple of 0.5 dB.

In some implementations, the noise analysis engine 115 can include one or more adaptive filters to remove the effects of the input audio captured as a portion of the microphone signal 104. In some implementations, the adaptive filtering can be performed based on a Normalized Least-Means-Squares (NLMS) adaptive filter having a finite impulse response (FIR) filter structure. For example, in one particular implementation, a FIR filter of fixed length was used as the adaptive filter. In some implementations, the reference signal of the adaptive filter for a stereo input can be the linear sum of the left and right channels. For a 5.1-channel surround input audio signal, the output of a bass-management module may be used as the reference signal.

In some implementations, the output 212 of the one or more adaptive filters 210 is provided to a post-processing engine 215. After the adaptive filters 210 remove the effects of the input audio 105 from the microphone signal 104, the output 212 (also referred to as an error signal) can be considered to be a good approximation of the estimated noise. In some implementations, this noise estimate 212 may be further processed by the post-processing engine 215 before the noise estimate is used in the boost gain computations, as performed, for example, by the loudness analysis engine 120 described with reference to FIG. 1.

In some implementations, frequent changes in the noise estimate 212 may cause rapid increases and decreases (which may be referred to as "pumping") in the output audio 130 if used without smoothing. In some implementations, the noise estimate 212 includes not only the steady state noise usable for compensation, but also unwanted interferences such as impulse noise and speech activities that occur inside the vehicle cabin. In some implementations, the post-processing engine 215 can be configured to perform impulse noise removal and speech rejection, for example, in the high-frequency range that may overlap with the band in which these types of interference are active.

Figure 2B:
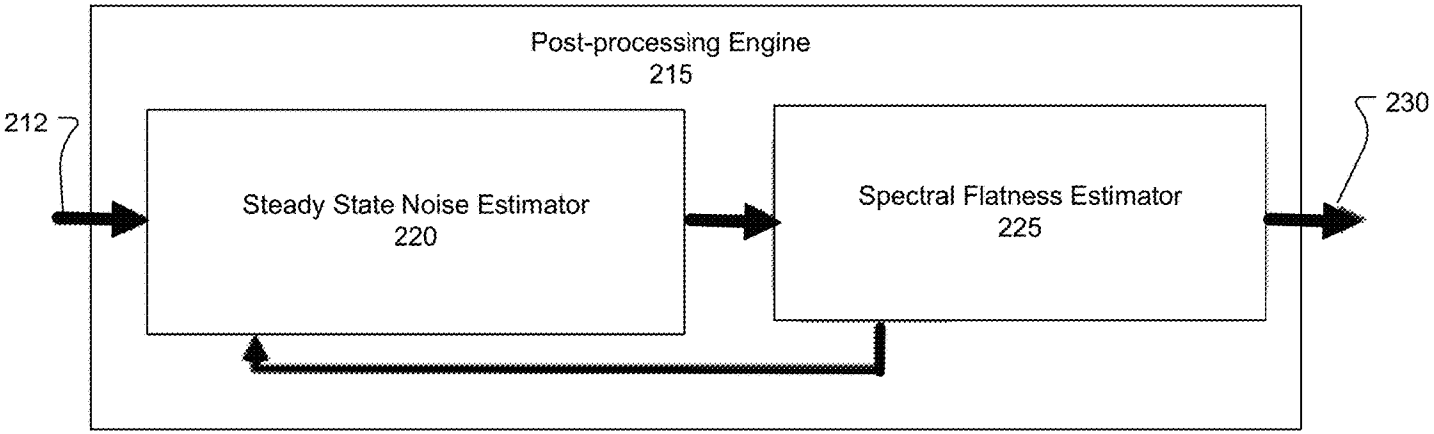
FIG. 2B is a block diagram of an example post-processing engine that may be used in the system depicted in FIG. 2A.

FIG. 2B is a block diagram of an example post-processing engine 215. In some implementations, the post-processing engine 220 includes a steady state noise estimator 220 that is configured to estimate the steady-state noise floor within the bandwidth of interest and filter out one or more types of interference, including, for example, impulse noise and speech components. In some implementations, this may be performed using a power spectral density (PSD) estimation process such as the process depicted in the reference: Noise Power Spectral Density Estimation Based on Optimal Smoothing and Minimum Statistics, *IEEE Transactions on Speech and Audio Processing*, July 2001—the entire contents of which are incorporated herein by reference.

In some implementations, the steady state noise estimator can be configured to transform the error signal or noise estimate 212 from the adaptive filter 210 to a frequency domain representation, which is then dynamically smoothed. In some implementations, the smoothing filter may be optimized in the minimum-mean-square error sense. Representing the frequency-domain noise sample as Y(n, k) (where n is the frame index, and k is the frequency bin index, k=0, 1, 2 . . . L−1), the PSD of Y(n, k) can be estimated by:

$$P(n,k)=\alpha(n,k)P(n-1,k)+(1-\alpha(n,k))|Y(n,k)|^2 \tag{1}$$

where $\alpha(n, k)$ is the smoothing parameter.

Further, representing the estimated noise at frame n and frequency bin k as $\hat{\sigma}^{-2}(n, k)$, the smoothing parameter $\alpha(n,k)$ can be computed as:

$$\alpha(n, k) = \frac{C \cdot \alpha_c(n)}{1 + \left(\frac{P(n-1, k)}{\hat{\sigma}^2(n-1, k)} - 1\right)^2} \tag{2}$$

where C is an empirical constant, and $$\alpha_c(n)=\beta\cdot\alpha_c(n-1)+(1-\beta)\cdot\tilde{\alpha}_c(n) \tag{3}$$

where $$\tilde{\alpha}_c(n) = \frac{1}{1 + \left(\frac{\sum_{i=0}^{L-1} P(n-1, i)}{\sum_{i=0}^{L-1} |Y(n, i)|^2} - 1\right)^2} \tag{4}$$

and $\beta$ is a forgetting factor between 0 and 1. In some implementations, the estimated noise $\hat{\sigma}^2(n, k)$ can be the obtained via a minimum search across multiple values of P(n, k) over a pre-defined time interval, which is then passed through a spectral flatness estimator 225.

In some implementations, the minimum search process may be executed by the steady state noise estimator 220, and passed on to the spectral flatness estimator 225, which in turn provides the output $\hat{\sigma}^2(n, k)$ as a feedback to the steady state noise estimator 220. The minimum search may be conducted over the smoothed PSD of the noise estimate across frequency bins over the predetermined time interval. The number of frequency bins can depend on the size of the Fast Fourier Transform (FFT) used in the process. For example, the number of unique frequency bins corresponding to a 256 point FFT is 129. In some implementations, all 129 unique bins may be analyzed in the minimum search process. In some implementations, computational effort (measured in million instructions per second (MIPS)) and/or memory can be saved by skipping every other bin (e.g., by processing only 65 bins) without significant degradation in the accuracy of the analysis. In this example, searching the 65 frequency bins to determine a spectral minimum over a time window of 3 seconds can require storage of 4198 samples (number of bins (65)×time window (3s)×FFT frame rate 21.53 Hz).

Figure 3:
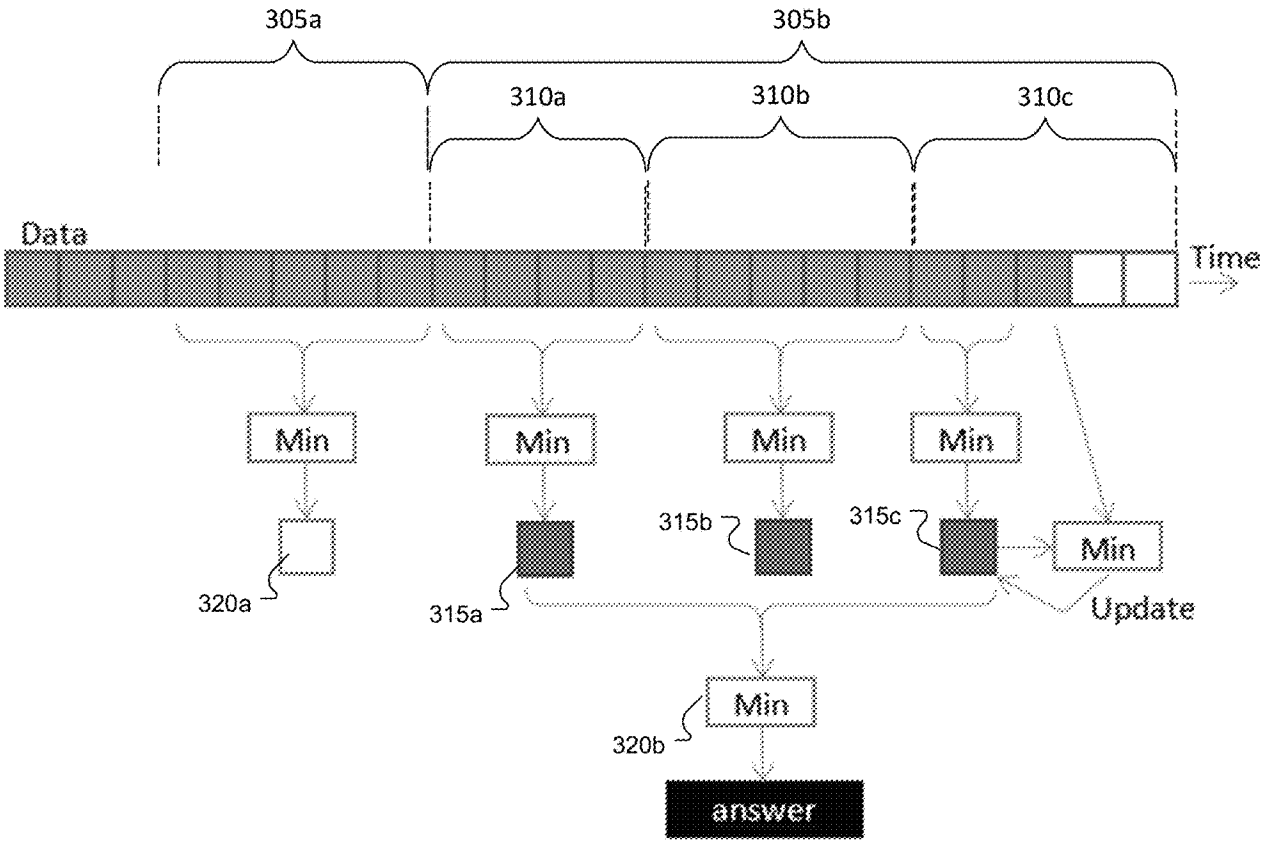
FIG. 3 is a schematic diagram illustrating a search process across power-spectral densities of different frequency bins.

In some implementations, a divide and conquer approach, such as the one illustrated in FIG. 3 may be used to reduce the memory usage. In the example approach shown in FIG. 3, for each frequency bin, instead of storing long windows 305*a*, 305*b* (305, in general) of data, a number of sub-windows 310*a*-310*c* (310, in general) may be stored while analyzing PSD values within a given window 305. The sub-windows 310 may be of equal or different sizes. A running search of the spectral minimum is performed in each sub-window 310 sequentially with the incoming samples, and only the minimum values (315*a*, 315*b*, 315*c*, 315*d*, etc., 315, in general) corresponding to the different sub-windows 310 are stored. For example, referring to the sub-window 310*c*, the minimum PSD of the first two samples is stored as the running minimum 315*c*. If the PSD corresponding to the third frequency sample within the sub-window 310*c* is found to be less than the current running minimum 315*c*, the running minimum is updated accordingly. This is repeated until the last frequency bin of the time sub-window 310*c* has been analyzed, and the running minimum value 315*c* is assigned as the true minimum for the sub-window 310*c*. Before the true minimum of the sub-window is reached, the running minimum can serve as the representative of this sub-window in a subsequent step. This allows subsequent steps to be performed without converging on the true minimum for the sub-window, thereby reducing latency of the overall system. When the running pointer reaches the beginning of a particular sub-window 310, the local minimum computation for that sub-window is initiated. Once the minimum values for each sub-window 310 within a window 305 is calculated, the global minimum 320 is determined as the minimum of the local minimums 315. In the example of FIG. 3, the global minimum 320*b* for the window 305*b* is determined as the minimum of the values 315*a*, 315*b*, and 315*c*, which are the local minima stored for sub-windows 310*a*, 310*b*, and 310*c*, respectively. For the example given above, using three sub-windows of 22 samples each requires storing only 195 samples per window, thereby significantly reducing the memory requirement for the minimum search process.

In some implementations, the post-processing engine 215 includes a spectral flatness estimator 225. In some cases, using such a spectral flatness estimator 225 may improve the robustness of speech rejection by applying a flatness test to the minimum search output in order to determine whether to accept or reject an updated value. In some implementations, speech signal and/or music residuals in the output of the adaptive filter 210 can have significant fluctuations and sporadic peaks across frequency bins, while the steady state noise floor is relatively flat within certain frequency bands. In such cases, a flatness test may improve the robustness of the minimum search method by facilitating better rejection of any rapid fluctuations. Representing the output of the minimum search for the nth frame and kth frequency bin as $P_{min}(n, k)$, and the measured flatness for the nth frame as F(n), the estimated noise power spectrum can be given by:

$$\hat{\sigma}^2(n,k)=\theta\cdot P_{min}(n,k)+(1-\theta)\cdot\hat{\sigma}^2(n-1,k),\ \text{if } F(n) > F_\text{threshold}\ \hat{\sigma}^2(n,k)=\hat{\sigma}^2(n-1,k),\ \text{else} \tag{5}$$

where θ is a forgetting factor between 0 and 1 and F_threshold is a threshold of flatness that is determined empirically. In one example, the value of F_threshold was set at 0.9.

In some implementations, the flatness measure can be defined as the ratio between the geometric average and the arithmetic average of the spectral samples, as given by:

$$F(n) = \frac{\sqrt[(L2-L1+1)]{\prod_{k=L1}^{L2} P_{min}(n,k)}}{\frac{\sum_{k=L1}^{L2} P_{min}(n,k)}{(L2-L1+1)}} = \frac{\exp\left(\frac{1}{(L2-L1+1)}\sum_{k=L1}^{L2}\log P_{min}(n,k)\right)}{\frac{1}{(L2-L1+1)}\sum_{k=L1}^{L2} P_{min}(n,k)} \tag{6}$$

where L1 represents the index of the first frequency bin and L2 is the index corresponding to the last frequency bin in the nth frame. In some implementations, the flatness test can be conducted on a subset of frequency bands within a frame, for example, to avoid the effects of the band-pass filter transition bands. For example, the flatness test may be conducted based on a group of frequency bins in the middle of the pass-band, which include about 40 bins, equivalent to a bandwidth of about 900 Hz.

The output 230 of the post-processing engine can be provided to the loudness analysis engine 120 for computation of gain adjustment signals. In some implementations, the output 230 is generated based on computing a ratio between the low-frequency and high-frequency noise estimates, wherein the ratio (also known as the noise-profile metric) is used by the loudness analysis engine 120 to compute the gain adjustments or compensations. On a logarithmic scale, the ratio is simply the difference between the low-frequency and the high-frequency noise levels in dB. In some implementations, the ratio can be bound to a specific range in accordance with the type of noise that is compensated. For example, when the vehicle travels on an average road surface with the windows and roof all closed, the ratio can be about 60 dB. When the windows and/or roof are open, the ratio can be about 45 to 50 dB to account for the wind noise.

In some implementations, the loudness analysis engine 120 can be configured to generate a control signal for adjusting the audio system (e.g., by controlling the gain adjustment circuit 125) in accordance with the output 230 of the post-processing engine. In some implementations, the loudness analysis engine 120 can be configured to calculate a modified signal to noise ratio (SNR) by using the output of the source analysis engine 110 as the signal of interest, and the output 230 as a signal indicative of the noise within the vehicle cabin. The modified SNR can then be compared to a threshold or target SNR value, and the control signal for the gain adjustment circuit may be generated to reduce any deviation from the target SNR value. In some implementations, generating the control signal for the gain adjustment circuit 125 can include computing a signal to noise ratio (SNR) indicative of a relative power of the output of the vehicular audio system compared to the power of the input signal, and generating the control signal upon determining that the SNR satisfies a threshold condition.

In some implementations, the gain compensation described above may be performed separately for different frequency bands such as ranges corresponding to bass, mid-range, and treble. The SNR dependent gain compensation can be computed using one or more boost maps such as ones described in U.S. Pat. No. 9,615,185, U.S. application Ser. No. 14/918,145, filed on Oct. 20, 2015, and U.S.

application Ser. No. 15/282,652, filed on Sep. 30, 2016, the entire contents of which are incorporated herein by reference.

The technology described herein can be used to mitigate effects of variable noise on the listening experience by adjusting, automatically and dynamically, the music or speech signals played by an audio system in a moving vehicle. In some implementations, the technology can be used to promote a consistent listening experience without typically requiring significant manual intervention. For example, the audio system can include one or more controllers in communication with one or more noise detectors. An example of a noise detector includes a microphone placed in a cabin of the vehicle. The microphone is typically placed at a location near a user's ears, e.g., along a headliner of the passenger cabin. Other examples of noise detectors can include speedometers and/or electronic transducers capable of measuring engine revolutions per minute, which in turn can provide information that is indicative of the level of noise perceived in the passenger cabin. An example of a controller includes, but is not limited to, a processor, e.g., a microprocessor. The audio system can include one or more of the source analysis engine 110, loudness analysis engine 120, noise analysis engine 115, and gain adjustment circuit 125. In some implementations, one or more controllers of the audio system can be used to implement one or more of the above described engines.

Figure 4:
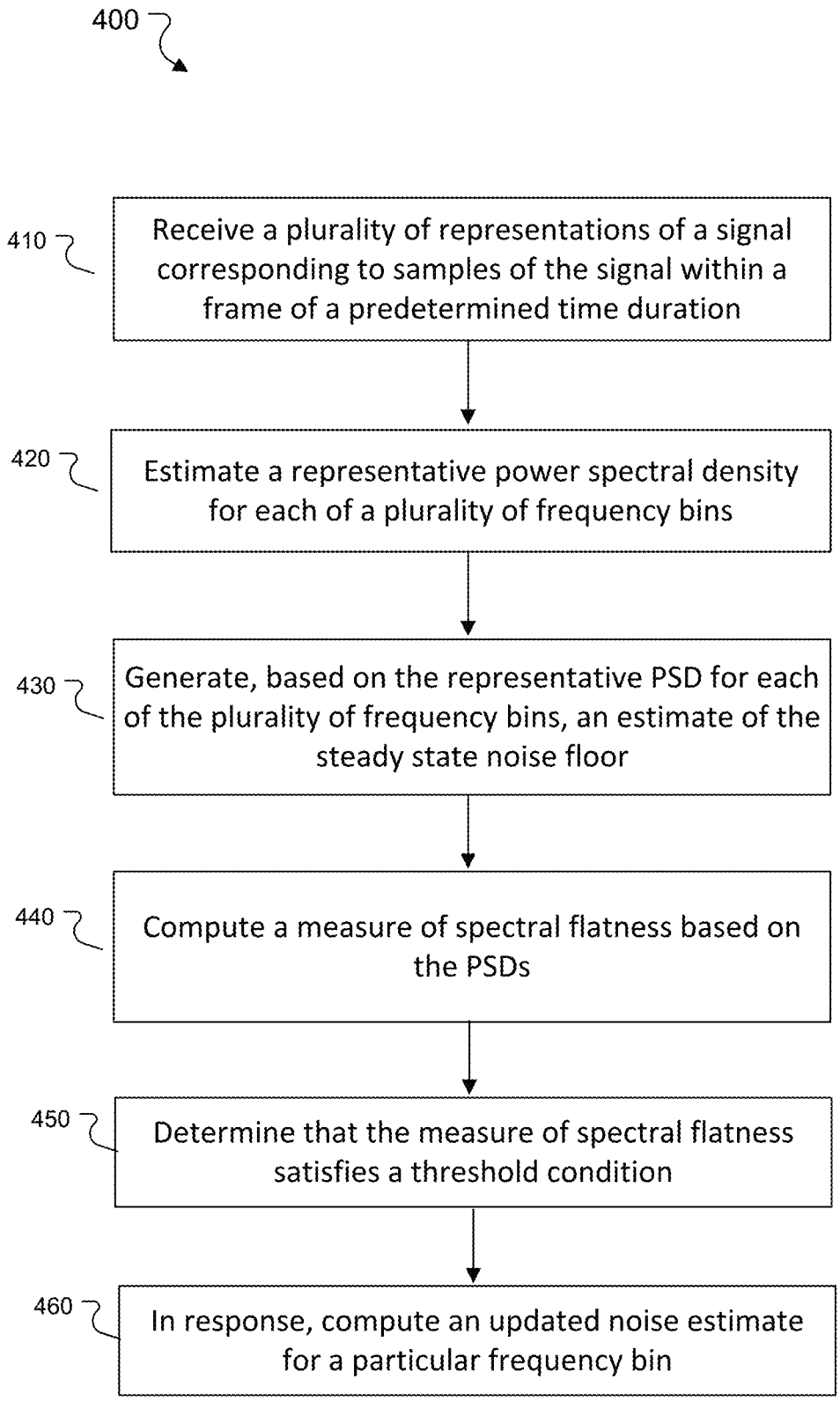
FIG. 4 is a flow chart of an example process for computing and updating a noise floor.

FIG. 4 is a flow chart of an example process 400 for computing and updating a noise floor in accordance with the technology described herein. In some implementations, the operations of the process 400 can be executed, at least in part, by the noise analysis engine 115 described above. Operations of the process 400 includes receiving a plurality of representations of the signal corresponding to samples of the signal within a frame of predetermined time duration (410). In some implementations, the plurality of representations of the signal can include time-domain representations such as samples of the signal. In some implementations, the plurality of representations of the signal can include frequency-domain representations such as FFT samples (or other frequency domain representations) calculated from samples of the signal.

Operations of the process 400 can also include estimating a PSD for each of a plurality of frequency bins (420). The PSD for a particular frequency bin can be estimated, for example, based on a smoothing parameter calculated from a noise estimate for the particular frequency bin as obtained from samples corresponding to a preceding frame. In some implementations, the PSD for a frequency bin can be estimated using equations (1)-(4) described above. For example, the smoothing parameter for the particular frequency bin can be calculated based also on an estimate of PSD for the same frequency bin in a preceding frame, as shown in equation (1).

Operations of the process 400 includes generating, based on the PSD for each of the plurality of frequency bins, an estimate of the steady-state noise floor (430). In some implementations, this can include obtaining a window of PSD values corresponding to the frame of predetermined time duration, dividing the corresponding PSDs into a plurality of sub-windows, and, determining a running minimum of PSDs in the sub-windows. The local minimum of the individual sub-windows can then be analyzed to determine the global minimum for the entire window as the spectral minimum corresponding to the frame or predetermined time duration. In some cases, this spectral minimum can be used as an estimate of the noise floor. The estimate of the noise floor may be dynamically updated for subsequent frames.

Operations of the process 400 also includes computing a measure of spectral flatness associated with the samples within the frame (440). In some implementations, the measure of flatness can be calculated based on PSDs calculated for at least a portion of the plurality of frequency bins. In some implementations, the measure o flatness can be calculated using equation (6).

Operations of the process can also include determining that the measure of spectral flatness satisfies a threshold condition (450), and in response, computing an updated estimate of the steady-state noise floor. In some implementations, this may be done in accordance with equation (5) described above. In some implementations, the updated estimate of the steady-state noise floor can be computed as a function of the noise estimate for the corresponding frequency bin as obtained from the samples corresponding to the preceding frame.

In some implementations, an output of a vehicular audio system may be adjusted based on the estimate of the steady-state noise floor. This can be done, for example, by a loudness analysis engine 120 that utilizes the estimate of the steady-state noise floor to generate a control signal configured to control a gain adjustment circuit (that can include, for example, a variable gain amplifier (VGA)). In some implementations, an SNR can be computed based on the estimate of the steady-state noise, and the control signal can be generated responsive to determining that the SNR satisfies a threshold condition. The SNR can be indicative of a relative power of the output of the vehicular audio system compared to the power of the noise perceived in the vehicle cabin, as indicated, for example, by the estimate of the noise floor. In some implementations, responsive to determining that the SNR satisfies a threshold condition (which indicates that the SNR is within a threshold range from a target SNR), a current gain of the vehicular system may be maintained.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory storage medium for execution by, or to control the operation of, data processing apparatus. The computer storage medium can be a machine-readable storage device, a machine-readable storage substrate, a random or serial access memory device, or a combination of one or more of them.

The term "data processing apparatus" refers to data processing hardware and encompasses all kinds of apparatus, devices, and machines for processing data, including by way of example a programmable digital processor, a digital computer, or multiple digital processors or computers. The apparatus can also be or further include special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, a module, a software module, a script, or code, can be written in any form of programming language, including compiled or interpreted languages, or declarative or procedural languages, and it can be deployed in any form, including as a standalone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit). For a system of one or more computers to be "configured to" perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Computers suitable for the execution of a computer program include, by way of example, can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer readable media suitable for storing computer program instructions and data include all forms of nonvolatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

Control of the various systems described in this specification, or portions of them, can be implemented in a computer program product that includes instructions that are stored on one or more non-transitory machine-readable storage media, and that are executable on one or more processing devices. The systems described in this specification, or portions of them, can be implemented as an apparatus, method, or electronic system that may include one or more processing devices and memory to store executable instructions to perform the operations described in this specification.

While this specification contains many specific implementation details, these should not be construed as limitations on the scope of any claims or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. A method for estimating a steady-state noise floor in a signal, the method comprising:

receiving a plurality of representations of the signal corresponding to samples of the signal within a frame of predetermined time duration;

estimating, by one or more processing devices, a power spectral density (PSD) for each of a plurality of frequency bins, wherein the PSD for a particular frequency bin is estimated based on a smoothing parameter calculated from a noise estimate for the particular frequency bin as obtained from samples corresponding to a preceding frame;

generating, based on the PSD for each of the plurality of frequency bins, an estimate of the steady-state noise floor;

computing a measure of spectral flatness associated with the samples within the frame, the measure of spectral flatness being calculated based on PSDs calculated for at least a portion of the plurality of frequency bins;

determining if the measure of spectral flatness satisfies a threshold condition, wherein the threshold condition is selected to emphasize steady-state noise across the portion of the plurality of frequency bins over spectral peaks in particular frequency bins in the same portion;

responsive to determining that the measure of spectral flatness satisfies the threshold condition, computing an updated estimate of the steady-state noise floor; and responsive to determining that the measure of spectral flatness does not satisfy the threshold condition, maintaining the steady-state noise floor estimate as obtained from the samples corresponding to the preceding frame.

2. The method of claim 1, wherein the updated estimate of the steady-state noise floor is computed as a function of the noise estimate for the corresponding frequency bin as obtained from the samples corresponding to the preceding frame.

3. The method of claim 1, further comprising adjusting an output of a vehicular audio system based on the estimate of the steady-state noise floor.

4. The method of claim 3, wherein the steady-state noise floor represents a steady-state noise within a vehicle-cabin associated with the vehicular audio system.

5. The method of claim 4, wherein adjusting the output of the vehicular audio system comprises:

receiving, at one or more processing devices, an input signal indicative of noise within the vehicle-cabin;

computing a signal to noise ratio (SNR) indicative of a relative power of the output of the vehicular audio system compared to the power of the input signal indicative of the noise; and generating a control signal for adjusting the vehicular audio system as a function of the SNR.

6. The method of claim 5, wherein the control signal boosts the output of the vehicular audio system in accordance with a difference between the SNR and a threshold, the output being constrained to an upper limit.

7. The method of claim 4, wherein adjusting the output of the vehicular audio system comprises:

receiving, at one or more processing devices, an input signal indicative of noise within the vehicle-cabin;

computing a signal to noise ratio (SNR) indicative of a relative power of the output of the vehicular audio system compared to the power of the input signal; and maintaining a gain level of the vehicular audio system upon determining that the SNR satisfies a SNR threshold condition.

8. The method of claim 1, wherein the smoothing parameter for the particular frequency bin is calculated based also on an estimate of PSD for the same frequency bin in a preceding frame.

9. The method of claim 1, wherein estimating the steady-state noise floor comprises:

determining a spectral minimum over the frame of predetermined time duration.

10. The method of claim 9, wherein determining the spectral minimum over the predetermined time duration comprises dividing the corresponding PSDs into a plurality of sub-windows, and, determining a running minimum of PSDs in the sub-windows.

11. The method of claim 1, wherein the plurality of representations of the signal comprises time-domain representations.

12. The method of claim 1, wherein the plurality of representations of the signal comprises frequency-domain representations.

13. A system for estimating a steady-state noise floor in a signal, the system comprising:

a steady-state noise estimator comprising one or more processing devices, the steady-state noise estimator configured to:

receive a plurality of representations of the signal corresponding to samples of the signal within a frame of predetermined time duration, estimate a power spectral density (PSD) for each of a plurality of frequency bins, wherein the PSD for a particular frequency bin is estimated based on a smoothing parameter calculated from a noise estimate for the particular frequency bin as obtained from samples corresponding to a preceding frame, generate, based on the PSD for each of the plurality of frequency bins, an estimate of the steady-state noise floor; and a spectral flatness estimator configured to compute a measure of spectral flatness associated with the samples within the frame, the measure of flatness being calculated based on PSDs calculated for at least a portion of the plurality of frequency bins, wherein the steady state noise estimator is further configured to:

determine, based on feedback from the spectral flatness estimator, if the measure of spectral flatness satisfies a threshold condition, wherein the threshold condition is selected to emphasize steady-state noise across the portion of the plurality of frequency bins over spectral peaks in particular frequency bins in the same portion, responsive to determining that the measure of spectral flatness satisfies the threshold condition, compute an updated estimate of the steady-state noise floor, and responsive to determining that the measure of spectral flatness does not satisfy the threshold condition, maintaining the steady-state noise floor estimate as obtained from the samples corresponding to the preceding frame.

14. The system of claim 13, wherein the updated estimate of the steady-state noise floor is computed as a function of the noise estimate for the corresponding frequency bin as obtained from the samples corresponding to the preceding frame.

15. The system of claim 13, further comprising a gain adjustment circuit configured to adjust an output of a vehicular audio system based on the estimate of the steady-state noise floor.

16. The system of claim 15, further comprising an analysis engine configured to:

receive an input signal indicative of noise within a vehicle-cabin associated with the vehicular audio system;

compute a signal to noise ratio (SNR) indicative of a relative power of the output of the vehicular audio system compared to the power of the input signal indicative of the noise; and generate a control signal for the gain adjustment circuit to adjust the vehicular audio system as a function of the SNR.

17. The system of claim 13, wherein the smoothing parameter for the particular frequency bin is calculated based also on an estimate of PSD for the same frequency bin in a preceding frame.

18. The system of claim 13, wherein the steady-state noise estimator is configured to estimate the steady-state noise floor by determining a spectral minimum over the frame of predetermined time duration.

19. The system of claim 18, wherein determining the spectral minimum over the predetermined time duration comprises dividing the corresponding PSDs into a plurality of sub-windows, and, determining a running minimum of PSDs in the sub-windows.

20. One or more non-transitory machine-readable storage devices having encoded thereon computer readable instructions for causing one or more processing devices to perform operations comprising:

receiving a plurality of representations of a signal corresponding to samples of the signal within a frame of predetermined time duration;

estimating a power spectral density (PSD) for each of a plurality of frequency bins, wherein the PSD for a particular frequency bin is estimated based on a smoothing parameter calculated from a noise estimate for the particular frequency bin as obtained from samples corresponding to a preceding frame;

generating, based on the PSD for each of the plurality of frequency bins, an estimate of a steady-state noise floor;

computing a measure of spectral flatness associated with the samples within the frame, the measure of spectral flatness being calculated based on PSDs calculated for at least a portion of the plurality of frequency bins; and determining if the measure of spectral flatness satisfies a threshold condition, wherein the threshold condition is selected to emphasize steady-state noise across the portion of the plurality of frequency bins over spectral peaks in particular frequency bins in the same portion;

responsive to determining that the measure of spectral flatness satisfies the threshold condition, computing an updated estimate of the steady-state noise floor; and responsive to determining that the measure of spectral flatness does not satisfy the threshold condition, maintaining the steady-state noise floor estimate as obtained from the samples corresponding to the preceding frame.

* * * * *